US007992407B2

(12) United States Patent
Kim et al.

(10) Patent No.: US 7,992,407 B2
(45) Date of Patent: Aug. 9, 2011

(54) REFRIGERATOR HAVING ICE BANK

(75) Inventors: Seong-Wook Kim, Gyeongsangnam-Do (KR); Si-Yeon An, Gyeongsangnam-Do (KR); Il-Wook Joung, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 398 days.

(21) Appl. No.: 12/233,342

(22) Filed: Sep. 18, 2008

(65) Prior Publication Data

US 2009/0077994 A1 Mar. 26, 2009

(30) Foreign Application Priority Data

Sep. 20, 2007 (KR) ..... 10-2007-0096149

(51) Int. Cl.
*F25C 5/18* (2006.01)
*F25C 5/02* (2006.01)

(52) U.S. Cl. ..... 62/344; 62/320

(58) Field of Classification Search ..... 62/320, 62/344; 403/316, 319; 411/517–519, 529
See application file for complete search history.

(56) References Cited

U.S. PATENT DOCUMENTS 5,613,321 A * 3/1997 Rizkovsky ..... 49/139
6,478,755 B2 * 11/2002 Young ..... 601/72
6,973,802 B1 * 12/2005 Seo et al. ..... 62/320
7,017,363 B2 * 3/2006 Lee et al. ..... 62/320
7,818,975 B2 * 10/2010 Chung et al. ..... 62/320

* cited by examiner

*Primary Examiner* — Frantz F Jules
*Assistant Examiner* — Cassey Bauer
(74) *Attorney, Agent, or Firm* — Birch, Stewart, Kolasch & Birch, LLP

(57) ABSTRACT

A refrigerator having an ice bank includes a rotation shaft to which a transfer unit for transferring ice pieces in the ice bank is connected, and having a coupling groove on an outer circumferential surface of the end thereof; a joint penetrated by the rotation shaft; a driving shaft connected to the joint, and transmitting a driving force of a motor to the joint; and a coupling ring coupled to the coupling groove of the rotation shaft penetrating the joint. Since the coupling ring is locked by the joint, the rotation shaft is prevented from being arbitrarily separated from the joint. The rotation shaft can be rotated in forward and backward directions. Furthermore, since the rotation shaft has a length shorter than a rotation shaft having screw threads and nuts, the motor can have a compact configuration.

11 Claims, 6 Drawing Sheets

REFRIGERATOR HAVING ICE BANK

RELATED APPLICATION

The present invention relates to subject matter contained in priority Korean Application 10-2007-0096149, filed Sep. 20, 2007, which is herein expressly incorporated by reference in its entirety.

BACKGROUND OF THE INVENTION

1. Field of the Invention

The present invention relates to a refrigerator, and more particularly, to a refrigerator having an ice bank capable of precisely transmitting a rotational force occurring from a driving motor in forward and backward directions to a rotation shaft of the ice bank.

2. Description of the Background Art

A refrigerator serves to store food items in a fresh state. The refrigerator may include an ice maker to make ice pieces, and an ice bank to receive therein ice pieces made by the ice maker.

Recently, a refrigerator having the ice maker and the ice bank is being widely used due to increased demands therefor.

Configurations and operations of the ice maker and the ice bank will be explained in brief.

Once ice pieces made by the ice maker drop into the ice bank, the ice pieces may be transferred, by a transfer unit, to an outlet of a case of the ice bank. Then, the ice pieces are transferred to a user through the outlet.

The transfer unit includes a fixed blade, and a rotatable blade crossing the fixed blade. The rotatable blade may be connected to a motor by a rotation shaft, thereby being rotated as the motor is driven.

The rotation shaft to which the rotatable blade is coupled to a joint rotatably disposed in the ice bank case. Accordingly, as a driving shaft of the motor is connected to the joint, the rotation shaft can rotate by a driving force of the motor.

However, the conventional ice bank has the following problems in a coupled state between the rotation shaft and the joint to each other.

More concretely, a screw thread is formed at the end of the rotation shaft having the rotatable blade coupled thereto, and the rotation shaft is made to penetrate the joint. Then, additional nuts are coupled to the screw thread disposed at the end of the rotation shaft, thereby coupling the rotation shaft and the joint to each other.

Here, when the motor is made to rotate in a reverse direction, the coupled state between the rotation shaft and the joint may be released. In order to solve the problem, the additional nuts are replaced by nuts having screw threads, or a bonding process is additionally performed. This may degrade the reliability of a coupled state between the rotation shaft and the joint, and cause the rotation shaft not to rotate in forward and backward directions.

SUMMARY OF THE INVENTION

Therefore, it is an object of the present invention to provide a refrigerator provided with an ice bank having a coupled structure between a rotation shaft to which a rotatable blade is connected and a joint, capable of rotating the rotation shaft of the ice bank in forward and backward directions.

To achieve these and other advantages and in accordance with the purpose of the present invention, as embodied and broadly described herein, there is provided a refrigerator having an ice bank, comprising: a case for storing ice pieces; a rotation shaft for transferring ice pieces inside the case by being rotated; a joint fixed to one side of the rotation shaft, and receiving a rotational force; and a joint coupling unit for coupling the rotation shaft and the joint to each other so that the rotation shaft can rotate in forward and backward directions.

Here, the rotation shaft may be penetratingly fixed to one side of a wall of the case so as to be rotatable. The joint coupling unit may be coupled to one side of the rotation shaft exposed to outside of the case.

Here, the rotation shaft may be selectively connected to a driving unit disposed outside the case so as to be rotatable.

Here, the joint coupling unit may include a coupling hole formed at the joint, and allowing the rotation shaft to penetrate therethrough; and a joint supporting portion for preventing the joint coupled to the rotation shaft from moving in a shaft direction.

Here, the coupling hole is formed to have a polygonal shape so that the joint and the rotation shaft can not perform a relative motion. One side of the rotation shaft coupled to the coupling hole may be formed to have a polygonal section in correspondence to the coupling hole.

Here, the driving unit may include a driving motor for generating a rotational force, and a driving shaft for transmitting a rotational force generated from the driving motor to the joint.

Here, the joint supporting portion may include a coupling ring fixed to the rotation shaft, and preventing the joint coupled to the rotation shaft from moving in a shaft direction; and a coupling groove formed on an outer circumferential surface of the rotation shaft, and coupling the coupling ring.

Here, the coupling ring may be formed to face at least three points of the coupling groove at different angles.

Here, the coupling ring may include connecting portions curved with a certain curvature, two end protrusions protruding from both ends of the connecting portions, and a middle protrusion protruding from the two end protrusions of the connecting portions.

Here, the connecting portions may be implemented as members having elasticity.

Here, the driving unit may include a driving motor disposed inside a wall body; and a driving shaft rotated by the driving motor, and exposed to one surface of the wall body. The case may be detachably installed on a surface of the wall body so that the rotation shaft and the driving shaft can be connected to each other.

Here, the wall body may be one of a plurality of wall bodies that form a storage space to store ice pieces in a frozen state, and the driving shaft may be provided to be exposed to inside of the storage space.

Here, the storage space may include an opened surface communicated with outside, and a door for opening and closing the opened surface. The wall body may be the door, and the driving shaft may be provided to be exposed to inside of the storage space.

The refrigerator having an ice bank of the present invention has the following effects.

Firstly, since the coupling ring is coupled to the coupling groove of the rotation shaft after the rotation shaft is penetratingly formed at the joint, the coupling ring is locked by the joint, thereby preventing the rotation shaft from being separated from the joint.

Secondly, the coupling ring and the coupling groove can maintain a coupled state therebetween regardless of a rotation direction of the rotation shaft and the joint. Accordingly, even if the rotation direction of the rotation shaft and the joint changes into a forward direction or a backward direction as the motor rotates, the coupled state between the coupling ring and the coupling groove is not released. This allows the rotation shaft to be rotated in forward and backward directions.

Thirdly, the rotation shaft and the joint are coupled to each other according to the structures of the coupling ring and the coupling groove, thereby needing not install screw threads for coupling with nuts at the rotation shaft. Here, the rotation shaft can have a length shorter than a rotation shaft having screw threads and nuts. This allows the motor to have a compact configuration.

Fourthly, the coupling ring is provided with the two end protrusions and the middle protrusion, and the three protrusions are installed so as to face three points of the coupling groove at different angles. This allows a coupled state between the coupling ring and the coupling groove to be stably maintained.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, a refrigerator having an ice bank according to the present invention will be explained in more detail.

Figure 1:
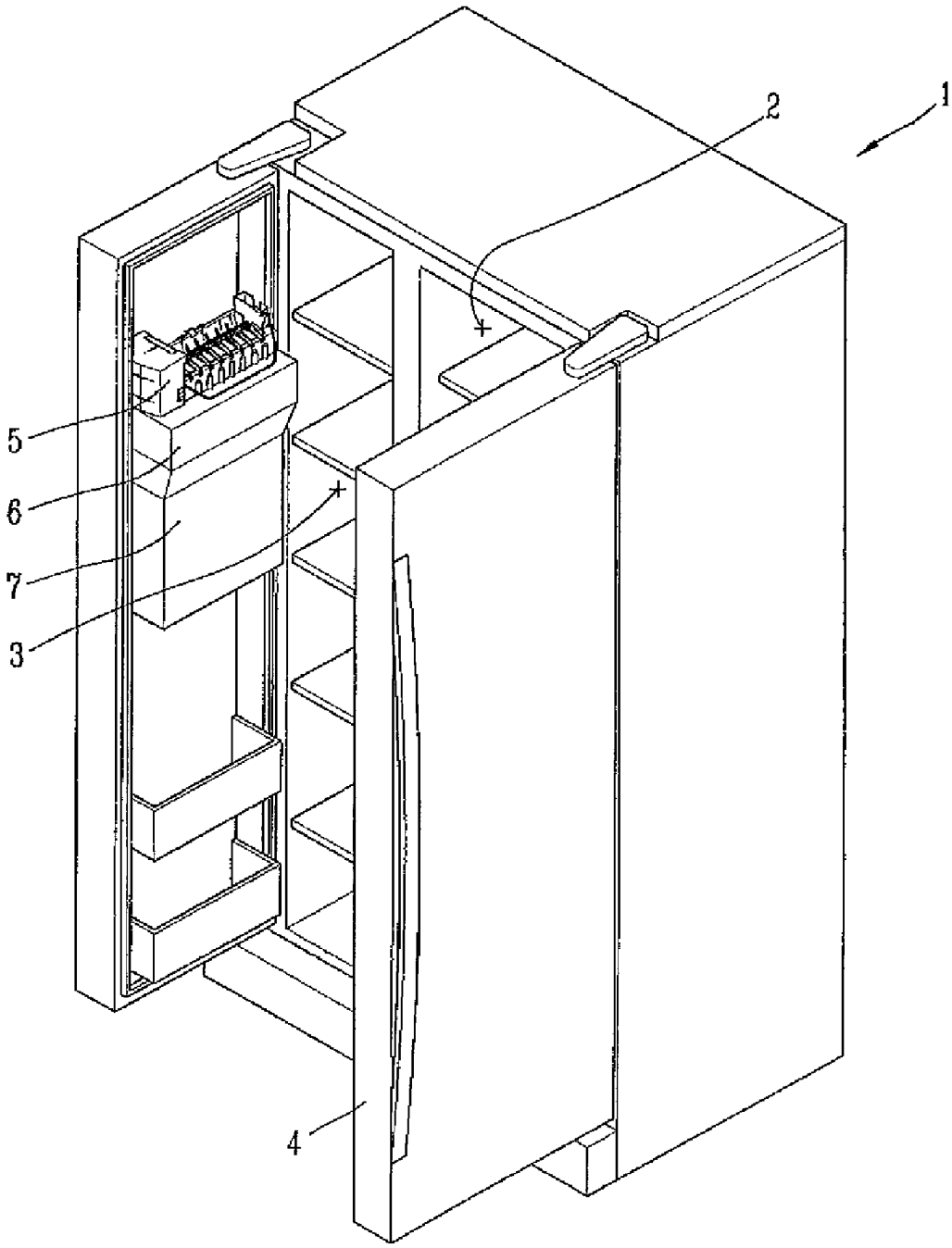
FIG. 1 is a perspective view showing a refrigerator having an ice bank according to the present invention.

FIG. 1 is a perspective view showing a refrigerator having an ice bank according to the present invention.

Referring to FIG. 1, a refrigerator 1 serving to store food items comprises: a refrigerating chamber 2 for storing food items at a temperature above zero; a freezing chamber 3 for storing food items such as ice pieces at a temperature below zero; an ice maker 5 received in the freezing chamber 3, and making ice pieces; an ice bank 6 for storing ice pieces made by the ice maker 5; and a dispenser 7 for supplying the ice pieces stored in the ice bank 6 to a user. Here, components such as a compressor, a condenser, an expander, and an evaporator to constitute a refrigerating cycle are mounted in the refrigerator 1.

The operation of the ice maker 5 will be explained.

Firstly, a proper amount of water is supplied to the ice maker 5, and then, cool air is supplied to the ice maker 5 to make ice pieces. Then, the ice pieces made by the ice maker 5 drop into the ice bank 6 by the operation of the ice maker 5. The ice pieces received in the ice bank 6 are supplied to a user by the dispenser 7 by a desired amount whenever the user demands. In the ice bank 6, further formed are a crusher for crushing ice pieces into a suitable size, and a transfer unit for transferring the crushed ice pieces.

Figure 2:
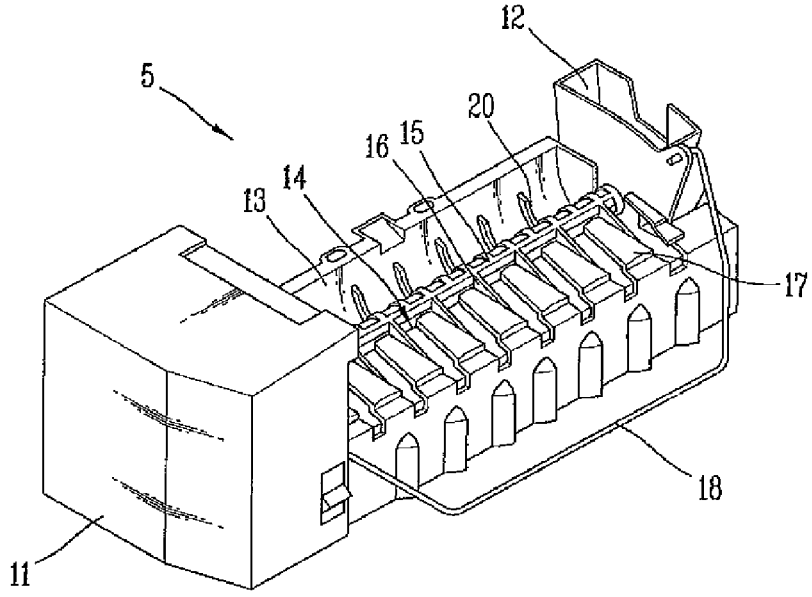
FIG. 2 is a perspective view showing an ice maker according to the present invention.

FIG. 2 is a perspective view showing the ice maker 5 according to the present invention.

Referring to FIG. 2, the ice maker 5 includes a water supply unit 12 for supplying water from outside, an ice making chamber 13 for making ice pieces, an ejector 14 for ejecting ice pieces made in the ice making chamber 13, and a control box 11 having a plurality of components therein to rotate the ejector 14. At a rear side of the ice making chamber 13, formed are a mounting unit 19 for mounting the ice maker 5 in the refrigerator, and a full level sensing lever 18 for sensing a state that the ice bank 6 is full of ice pieces, and thereby determining whether to operate the ice maker 5 or not.

In more detail, the ejector 14 includes a shaft 15 extending to outside of the control box 11 and performing a rotation motion; and an extension portion 16 extending to outside of the shaft 15, and ejecting ice pieces as the shaft 15 rotates. In the ice making chamber 13, there are formed partitioning protrusions 20 for dividing the ice making chamber 13 into a plurality of spaces so as to control the size of the ice pieces. Above the ice making chamber 13, there is formed a separator 17 for dropping the ice pieces ejected by the ejector 14 into the ice bank 6. Below the ice making chamber 13, there is formed a heater (not shown) for supplying heat so that the ice pieces can be separated from an interface with the ice making chamber 13.

The operation of the ice maker 5 will be explained with reference to the above configuration.

Firstly, water is supplied to the water supply unit 12 through a water supply pipe having a prescribed shape. Then, the water is introduced into the ice making chamber 13 to be received in the respective spaces partitioned from each other by the partitioning protrusions 20. Then, the water received in the ice making chamber 13 is frozen by supplied cool air having a temperature below zero.

Once the water in the ice making chamber 13 is completely frozen, the ejector 14 is operated by a motor 32*a* disposed in the control box 11. More concretely, the shaft 15 is rotated and thus the extension portion 16 is rotated, thereby ejecting the ice pieces into the ice making chamber 13 along an inner circumferential surface of the ice making chamber 13. Before the ejector 14 is operated, heat supply by the heater 21 may be performed so that the ice pieces can be detached from an interface with the ice making chamber 13.

Once the ice pieces are ejected by the ejector 14, the ice pieces are guided by the separator 17 to drop into the ice bank 6.

While these processes are repeatedly performed, when the ice bank 6 is full of the ice pieces, the operation of the ice maker 5 is stopped as the full level state is sensed by the full level sensing lever 18.

Figure 3:
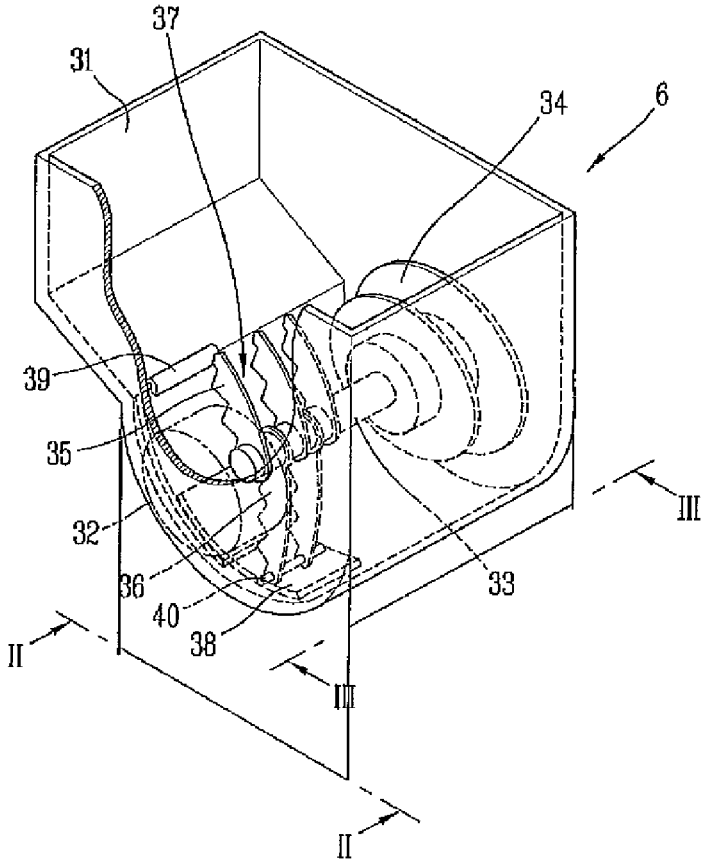
FIG. 3 is a perspective view showing an ice bank according to the present invention.
Figure 4:
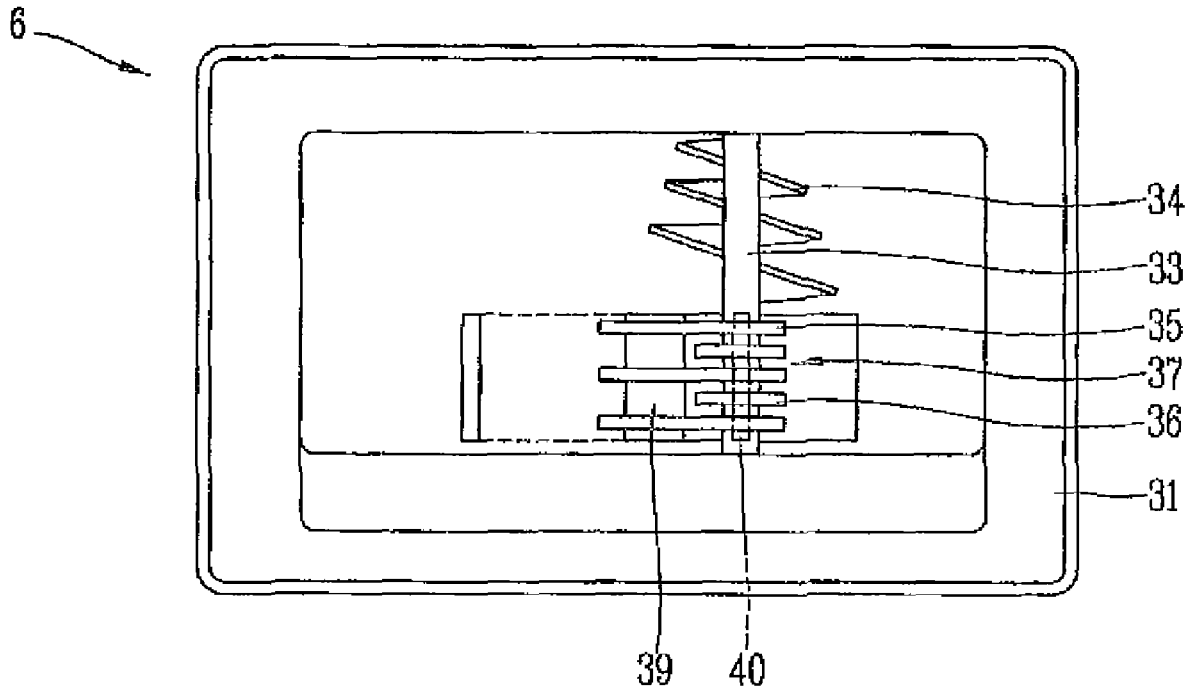
FIG. 4 is a planar view showing the ice bank according to the present invention.

FIG. 3 is a perspective view showing an ice bank according to the present invention, and FIG. 4 is a planar view showing the ice bank according to the present invention.

Referring to FIGS. 3 and 4, the ice bank 6 includes a case 31 having a storage space therein for storing ice pieces, and implemented to have an integral-type bucket structure; an ice crusher 37 disposed below the case 31; and a transfer unit 34 for transferring ice pieces to the ice crusher 37. As the transfer unit 34, an auger having a spiral shape may be used.

More concretely, the ice crusher 37 includes a fixed blade 36 having both ends coupled to each inner surface of the rotation shaft 33 and the case 31, a rotatable blade 35 that rotates with respect to the fixed blade 36, a rotation shaft 33 for inserting the rotatable blade 35 and receiving a rotational force, and a motor 32*a* connected to one end of the rotation shaft 33.

Hereinafter, the operation of the ice piece ice crusher 37 will be explained.

As the rotatable blade 35 rotates, ice pieces are guided to the ice crusher 37. Once the ice pieces are engaged between the rotatable blade 35 and the fixed blade 36, the ice pieces are crushed by a pushing operation of the rotatable blade 35, and then are made to drop through an outlet 38 below the fixed blade 36. It is also possible to form the dispenser below the outlet 38 so as to supply the ice pieces to a user.

Below the case 31, formed are the outlet 38 through which crushed ice pieces drop, and a shutter 39 for controlling the size of the ice pieces by changing an opened state of the outlet 38.

The motor 32*a* is disposed on an outer wall of the case 31, and is connected to the rotation shaft 33 that receives a rotational force. One end of the fixed blade 36 is fixed by a fixed blade fixing portion 4 disposed at one side of the case 31, and the rotation shaft 33 is inserted to a prescribed position of the fixed blade 36 thus to be supported. Therefore, even if the rotation shaft 33 rotates, the fixed blade 36 maintains a fixed state without rotating. To this end, the rotation shaft 33 may have a structure to be inserted into the fixed blade 36, rather than to be fixed to the fixed blade 36.

Hereinafter, the operation of the ice bank 6 will be explained.

Ice pieces made by the ice maker 5 drops into the ice bank 6 from an upper side of the case 31. The ice pieces received in the ice bank 6 are supplied to a user by a proper amount whenever the user wants. Once the motor 32*a* is operated, the rotation shaft 33 is rotated to operate the transfer unit 34. Then, the ice pieces are transferred by the transfer unit 34, are crushed by the ice crusher 37, and then are discharged out through the outlet 38.

The ice crusher 37 serves not only to crush ice pieces, but also to transfer the ice pieces, transferred by the transfer unit 34, to the outlet 38. In more detail, once the rotatable blade 35 starts to rotate under a state that the outlet 38 is opened, the ice pieces moving by the rotatable blade 35 are transferred to the outlet 38 before being crushed, by an interaction between the rotatable blade 35 and the fixed blade 36.

Here, the size of the ice pieces discharged out through the outlet 38 may be controlled by the operation of the shutter 39. Comparatively large-sized ice pieces are discharged out when the shutter 39 is opened, whereas comparatively small-sized ice pieces crushed by the fixed blade 36 are discharged out when the shutter 39 is closed.

Figure 5:
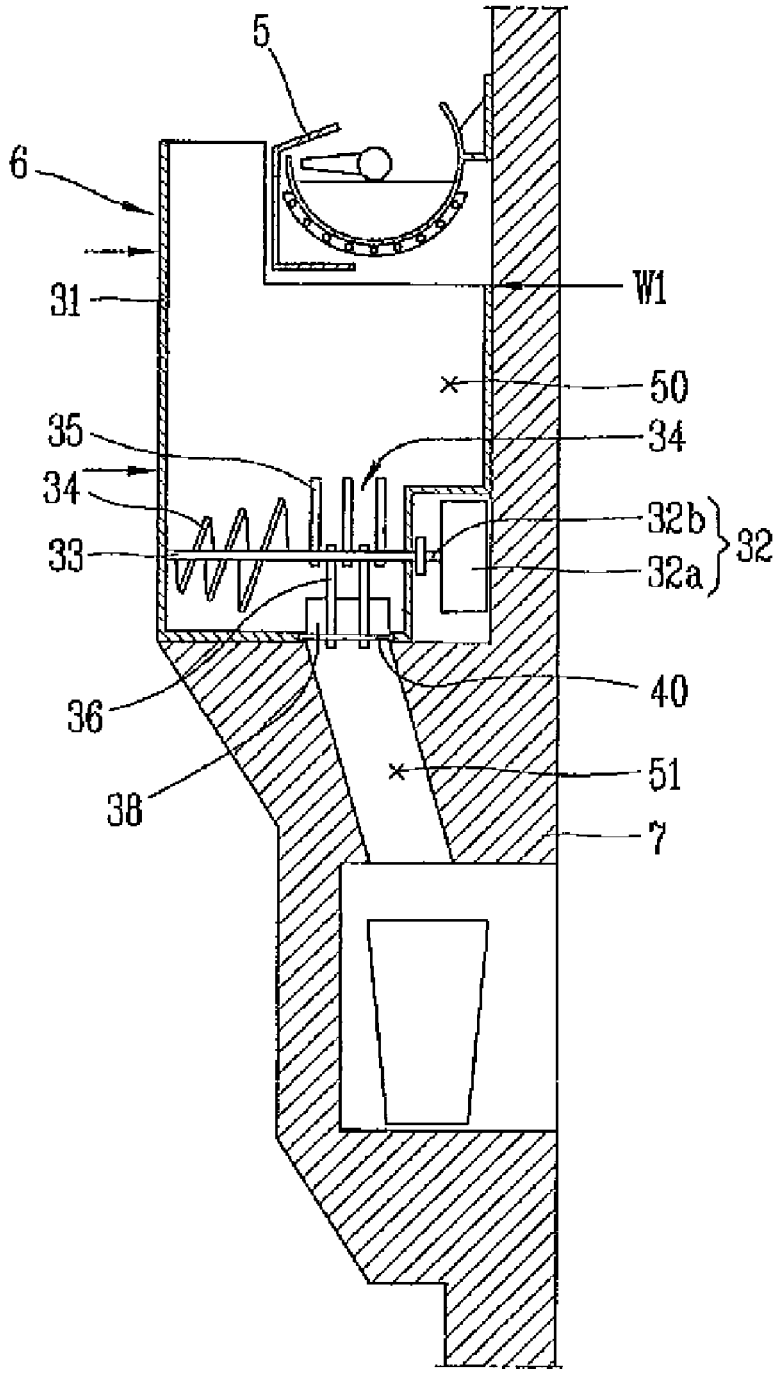
FIG. 5 is a vertical sectional view showing the ice bank according to the present invention.

FIG. 5 is a vertical sectional view showing the ice bank according to the present invention.

Referring to FIG. 5, the ice maker 5 for making ice pieces having a constant size is formed at an inner side of a freezing chamber door 4. The ice bank 6 for receiving ice pieces made by the ice maker 5 is formed below the ice maker 5. And, the dispenser 7 is formed to dispense ice pieces having a proper size from the ice bank 6 by a proper amount.

More concretely the ice bank 7 has the appearance implemented by the case 31 formed as an integral type. Also, the ice bank 7 has an inner space partitioned from an external space and storing ice pieces. At a lower inner surface of the case 31, disposed are the transfer unit 34 and the ice crusher 37 each supported by the rotation shaft 33. Here, the ice crusher 37 is provided with the fixed blade 36 and the rotatable blade 35, and serves to crush ice pieces into a proper size. The ice pieces having dropped into the ice bank 6 are supplied to the dispenser 7 through the outlet 38 and along a guide passage 51; thereby being dispensed to a user.

Figure 6:
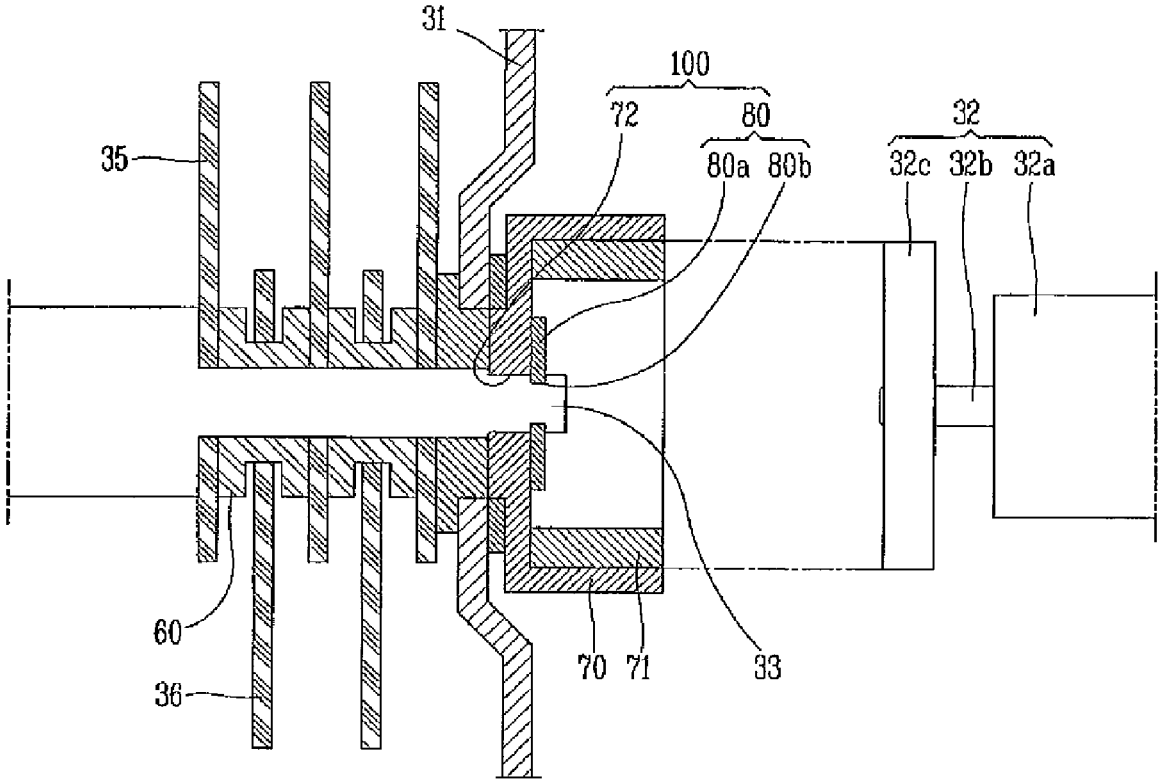
FIG. 6 is a sectional view showing a coupled state between a rotation shaft and a joint by a coupling ring and a coupling groove in the ice bank according to the present invention.
Figure 7:
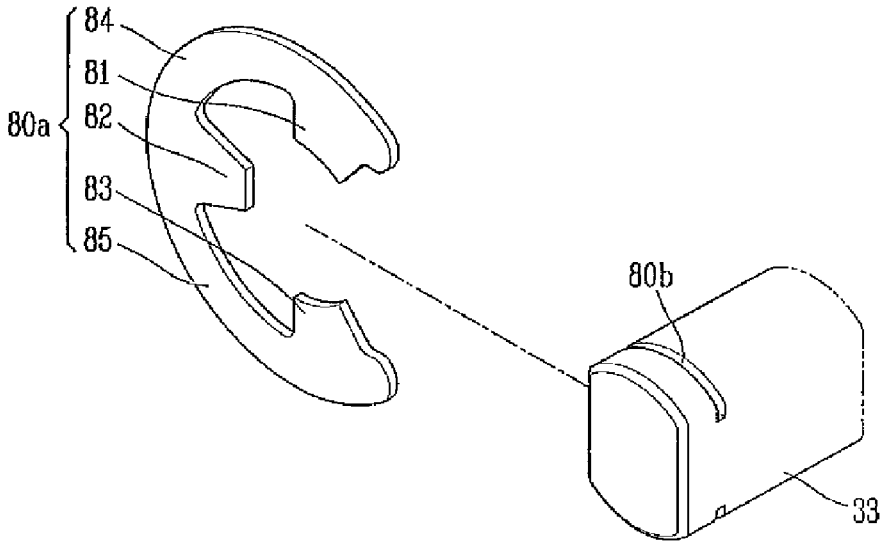
FIG. 7 is a perspective view showing the coupling ring and the coupling groove of the ice bank according to the present invention.
Figure 8:
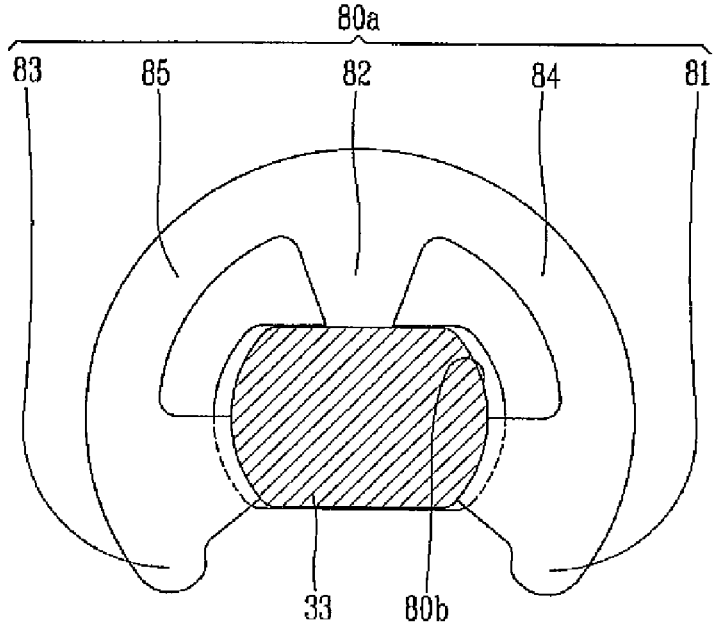
FIG. 8 is a partial sectional view showing a coupled state between the coupling ring and the coupling groove according to the present invention.
Figure 9:
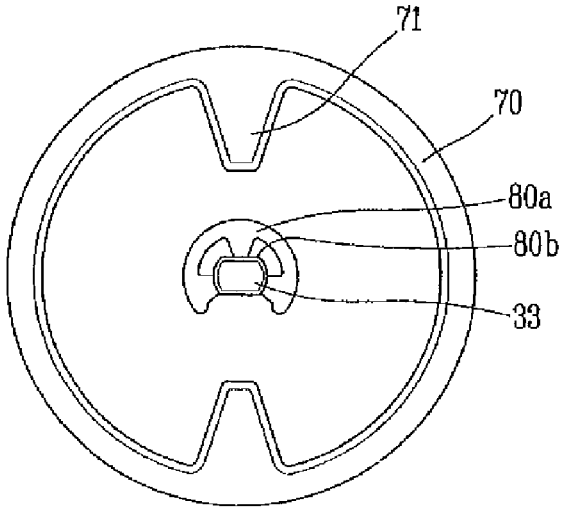
FIG. 9 is a view showing the joint under a state that the coupling ring and the coupling groove are coupled with each other according to the present invention.

FIG. 6 is a sectional view showing a coupled state between the rotation shaft and the joint by a coupling ring and a coupling groove in the ice bank according to the present invention, FIG. 7 is a perspective view showing the coupling ring and the coupling groove of the ice bank according to the present invention, FIG. 8 is a partial sectional view showing a coupled state between the coupling ring and the coupling groove according to the present invention, and FIG. 9 is a view showing the joint under a coupled state between the coupling ring and the coupling groove according to the present invention.

Referring to FIGS. 6 to 9, the ice bank 6 according to the present invention includes the case 31 for storing ice pieces, the rotation shaft 33 for transferring the ice pieces inside the case 31 by being rotated, the joint 70 fixed to one side of the rotation shaft 33 and receiving a rotational force, and a joint coupling unit 100 for coupling the rotation shaft 33 and the joint 70 with each other so that the rotation shaft 33 can rotate in forward and backward directions.

To the rotation shaft 33, may be connected the transfer unit 34 for transferring ice pieces in the case 31, the rotatable blade 35 for guiding the transferred ice pieces so as to crush or discharge out, and the fixed blade 36 for crushing the transferred ice pieces by interacting with the rotatable blade 35.

The rotation shaft 33 is disposed so that one part thereof can be exposed out via the case 31. The joint coupling unit 100 is coupled to an outer circumferential surface of the exposed part of the rotation shaft 33.

A driving unit 32 selectively connected to the rotation shaft 33 and transmitting a rotational force to the rotation shaft 33 is provided outside the case 31.

The driving unit 32 includes a motor 32*a* for generating a rotational force, and a driving shaft 32*b* for transmitting a rotational force generated from the motor 32*a* to the joint 70. Here, a driving protrusion 32*c* for transmitting a driving force to the joint 70 may be formed at the end of the driving shaft 32*b*.

As the driving shaft 32*b* rotates, the driving protrusion 32*c* formed at the end of the driving shaft 32*b*, and a joint protrusion 71 formed at the joint 70 may come in contact with each other. Accordingly, the driving shaft 32*b* and the joint 70 may rotate together with each other, thereby transmitting a driving force to the rotation shaft 33 having the joint 70 coupled thereto.

Hereinafter, an arrangement state of the driving unit 32 and the case 31 in the refrigerator will be explained in more detail.

The motor 32*a* of the driving unit 32 is fixed to inside of a wall body. And, the driving shaft 32*b* rotates by the motor 32*a*, and is exposed to one surface of the wall body.

The case 31 is detachably mounted to a surface of the wall body so that the rotation shaft 33 and the driving shaft 32*b* can be connected to each other.

Here, the wall body may be one of a plurality of wall bodies that form a storage space to store ice pieces in a frozen state. Preferably, the motor 32*a* is disposed in a door for opening and closing an opened surface that communicates the storage space with outside, and the driving shaft 32*b* is disposed to be exposed to inside of the storage space.

Hereinafter, the joint coupling unit 100 will be explained in more detail.

The joint coupling unit 100 includes a coupling hole 72 formed at the joint 70, and penetrated by the rotation shaft 33; and a joint supporting portion 80 for preventing the joint 70 coupled to the rotation shaft 33 from moving in a shaft direction.

Here, the coupling hole 72 is formed to have a polygonal shape so that the joint 70 and the rotation shaft 33 can be prevented from performing a relative motion. And, one side of the rotation shaft 33 coupled to the coupling hole 72 is formed to have a polygonal section in correspondence to the coupling hole 72.

Due to the polygonal section, a rotational force transmitted to the joint protrusion 71 by the driving protrusion 32*c* can be transmitted to the driving shaft 33 as it is.

The joint supporting portion 80 includes a coupling ring 80*a* fixed to the rotation shaft 33, and preventing the joint 70 coupled to the rotation shaft 33 from moving in a shaft direction; and a coupling groove 80*b* formed on an outer circumferential surface of the rotation shaft 33, and serving to couple the coupling ring 80*a*.

The coupling groove 80*b* is formed to be long and thin along an outer circumferential surface of the end of the rotation shaft 33, and serves to couple the coupling ring 80*a*.

The coupling ring 80*a* includes connecting portions 84 and 85 curved with a certain curvature, two end protrusions 81 and 83 protruding from both ends of the connecting portions 84 and 85, and a middle protrusion 82 protruding between the two end protrusions 81 and 82 of the connecting portions 84 and 85.

Here, the end protrusions 81 and 83, and the middle protrusion 82 may be formed to correspond to a surface shape of the coupling groove 80*b*, respectively. More concretely, the end protrusions 81 and 83 corresponding to curved portions of the coupling groove 80*b* may also have a shape curved with a prescribed curvature in correspondence to the curved portions. Likewise, the middle protrusion 82 corresponding to a flat portion of the coupling groove 80*b* may also have a flat shape in correspondence to the flat portion.

Here, the ends of the respective protrusions 81, 82 and 83 of the coupling ring 80*a* may come in contact with the surface of the coupling groove 80*b*, or may fasten the coupling groove 80*b*. The coupling ring 80*a*, especially, the connecting portions 84 and 85 may be configured to have elasticity, thereby enabling the coupling groove 80*b* to be fastened, and facilitating to couple the coupling ring 80*a* with the coupling groove 80*b*.

Once the rotation shaft 33 is installed to penetrate the joint 70, the coupling ring 80*a* is coupled with the coupling groove 80*b*. Accordingly, the coupling ring 80*a* is locked by the joint 70, thereby preventing the rotation shaft 33 is from being arbitrarily separated from the joint 70.

Furthermore, the coupling ring 80*a* and the coupling groove 80*b* can maintain a coupled state therebetween irrespective of a rotation direction of the rotation shaft 33 and the joint 70. Accordingly, even if a rotation direction of the rotation shaft 33 and the joint 70 changes into a forward direction or a backward direction as the motor 32*a* rotates, the coupled state between the coupling ring 80*a* and the coupling groove 80*b* is not released. This enables the rotation shaft 33 to be rotated in forward and backward directions.

Furthermore, the rotation shaft 33 and the joint 70 are coupled to each other according to the structures of the coupling ring 80*a* and the coupling groove 80*b*, thereby needing not install screw threads for coupling with nuts at the rotation shaft. Here, the rotation shaft 33 can have a length shorter than a rotation shaft having screw threads and nuts. This allows the driving apparatus to have a compact configuration.

Furthermore, the coupling ring 80*a* is provided with the two end protrusions 81 and 83, and the middle protrusion 82, and the three protrusions 81, 82 and 83 are installed so as to face three points of the coupling groove 80*b* at different angles. This allows a coupled state between the coupling ring 80*a* and the coupling groove 80*b* to be stably maintained.

Here, the coupling ring 80*a* may be installed so as to face two or four points of the coupling groove 80*b* at different angles, rather than three points of the coupling groove 80*b*.

The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator having an ice bank, comprising:

a case for storing ice pieces;

a rotation shaft for transferring ice pieces inside the case by being rotated;

a joint fixed to one side of the rotation shaft, and receiving a rotational force; and a joint coupling unit for coupling the rotation shaft and the joint with each other so that the rotation shaft can rotate in forward and backward directions, wherein the joint coupling unit comprises:

a coupling hole formed at the joint, and having the rotation shaft penetrating therethrough; and a joint supporting portion for preventing the joint coupled to the rotation shaft from moving in a shaft direction, wherein the coupling hole is formed to have a polygonal shape so that the joint and the rotation shaft cannot perform a relative motion, and wherein one side of the rotation shaft coupled to the coupling hole is formed to have a polygonal section in correspondence to the coupling hole.

2. The refrigerator having an ice bank of claim 1, wherein the rotation shaft is penetratingly fixed to one side of a wall of the case so as to be rotatable, and wherein the joint coupling unit is coupled to one side of the rotation shaft exposed to outside of the case.

3. The refrigerator having an ice bank of claim 1, wherein the rotation shaft is selectively connected to a driving unit disposed outside the case so as to be rotatable.

4. The refrigerator having an ice bank of claim 3, wherein the driving unit comprises:

a driving motor for generating a rotational force; and a driving shaft for transmitting a rotational force generated from the driving motor to the joint.

5. The refrigerator having an ice bank of claim 1, wherein the joint supporting portion comprises:

a coupling ring fixed to the rotation shaft, and preventing the joint coupled to the rotation shaft from moving in a shaft direction; and a coupling groove formed on an outer circumferential surface of the rotation shaft, and coupling the coupling ring.

6. The refrigerator having an ice bank of claim 5, wherein the coupling ring is formed to face at least three points of the coupling groove at different angles.

7. The refrigerator having an ice bank of claim 6, wherein the coupling ring comprises:

connecting portions curved with a certain curvature;

two end protrusions protruding from both ends of the connecting portions; and a middle protrusion protruding the two end protrusions of the connecting portions.

8. The refrigerator having an ice bank of claim 7, wherein the connecting portions are implemented as members having elasticity.

9. The refrigerator having an ice bank of claim 1, further comprising a driving unit, wherein the driving unit comprises:

a driving motor disposed inside a wall body; and a driving shaft rotated by the driving motor, and exposed to one surface of the wall body, and wherein the case is detachably installed on a surface of the wall body so that the rotation shaft and the driving shaft can be connected to each other.

10. The refrigerator having an ice bank of claim 9, wherein the wall body is one of a plurality of wall bodies that form a storage space to store ice pieces in a frozen state, and wherein the driving shaft is provided to be exposed to inside of the storage space.

11. The refrigerator having an ice bank of claim 9, wherein the storage space comprises:

an opened surface communicated with outside; and a door for opening and closing the opened surface, wherein the wall body is implemented as the door, and the driving shaft is provided to be exposed to inside of the storage space.

* * * * *